US005637045A

United States Patent [19]

Igarashi

[11] Patent Number: 5,637,045

[45] Date of Patent: Jun. 10, 1997

[54] HOLLOW WOOD-TYPE GOLF CLUB WITH VIBRATION DAMPENING

[76] Inventor: Lawrence Y. Igarashi, 30231 Tomas Rd., Rancho Santa Margarita, Calif. 92688

[21] Appl. No.: 461,574

[22] Filed: Jun. 2, 1995

[51] Int. Cl.[6] ..... A63B 53/04

[52] U.S. Cl. ..... 473/332; 473/345; 473/346; 273/DIG. 8

[58] Field of Search ..... 273/167 R, 167 H, 273/169, 167 F, 80.1, 80.2, DIG. 3, DIG. 8, DIG. 10, 77 R, 170, 171, 172, 173; 473/324–350

[56] References Cited

U.S. PATENT DOCUMENTS

| | | | |
|---|---|---|---|
| 1,658,581 | 9/1928 | Tobia . | |
| 1,968,627 | 7/1934 | Young . | |
| 2,846,228 | 8/1958 | Reach . | |
| 4,502,687 | 3/1985 | Kocheuar | 273/167 H |
| 4,516,778 | 5/1985 | Cleveland | 273/167 H |
| 4,582,321 | 4/1986 | Yoneyama . | |
| 4,811,950 | 3/1989 | Kobayashi . | |
| 4,875,679 | 10/1989 | Movilliat et al. . | |
| 4,928,972 | 5/1990 | Nakanishi et al. . | |
| 4,964,640 | 10/1990 | Nakanishi et al. . | |
| 5,000,454 | 3/1991 | Soda . | |
| 5,067,715 | 11/1991 | Schmidt et al. . | |
| 5,083,778 | 1/1992 | Douglass . | |
| 5,106,094 | 4/1992 | Desbiolles et al. . | |
| 5,213,328 | 5/1993 | Long et al. . | |
| 5,244,211 | 9/1993 | Lukasiewicz | 273/167 H |
| 5,312,105 | 5/1994 | Cleveland . | |
| 5,316,298 | 5/1994 | Hutin et al. . | |
| 5,351,958 | 10/1994 | Helmstetter | 273/167 H |
| 5,411,255 | 5/1995 | Kurashima | 273/167 H |

FOREIGN PATENT DOCUMENTS

| | | |
|---|---|---|
| 2672226 | 8/1992 | France . |

OTHER PUBLICATIONS

BJB Enterprises, Inc. Products, Material Safety Data Sheet F–70 A/B 70 Shore A Polyurethane Elastomer.

"New medallions provide golfers good vibrations," J. Achenbach, Golfweek, Mar. 25, 1995.

*Primary Examiner*—Sebastiano Passaniti

*Attorney, Agent, or Firm*—Larry K. Roberts

[57] ABSTRACT

A hollow wood-type golf club is fabricated with a thin layer of elastomeric dampening material coating the inner hollow cavity of the head shell. The layer provides vibration dampening, improving the play of the club. The vibration dampening material can also be applied in a thickened region at a desired location within the cavity to achieve a desired weighting to affect the balance of the head. A low cost, simple method to fabricate the head with the layer includes dispensing a quantity of uncured elastomer in liquid form into the cavity, coating the inner surface, pouring off the excess material, optionally weighing the head and adding an amount of the liquid elastomer to bring the head up to a desired nominal weight, maintaining the head at an attitude to cause the excess liquid to pool at a location at which additional weight is desired, and oven curing the elastomer with the head in this attitude until the elastomer has cured and hardened.

20 Claims, 3 Drawing Sheets

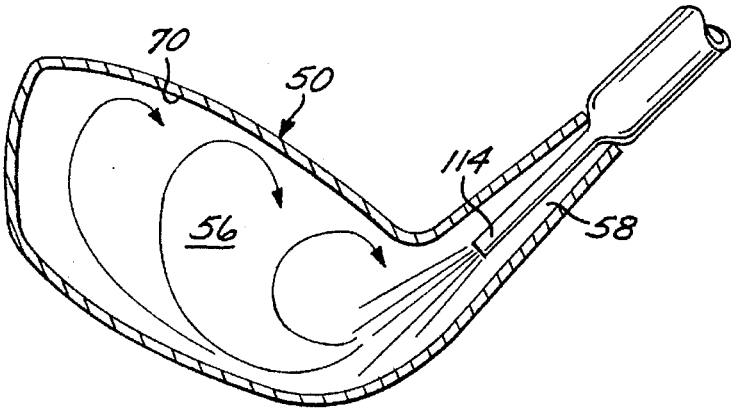
FIG. 3
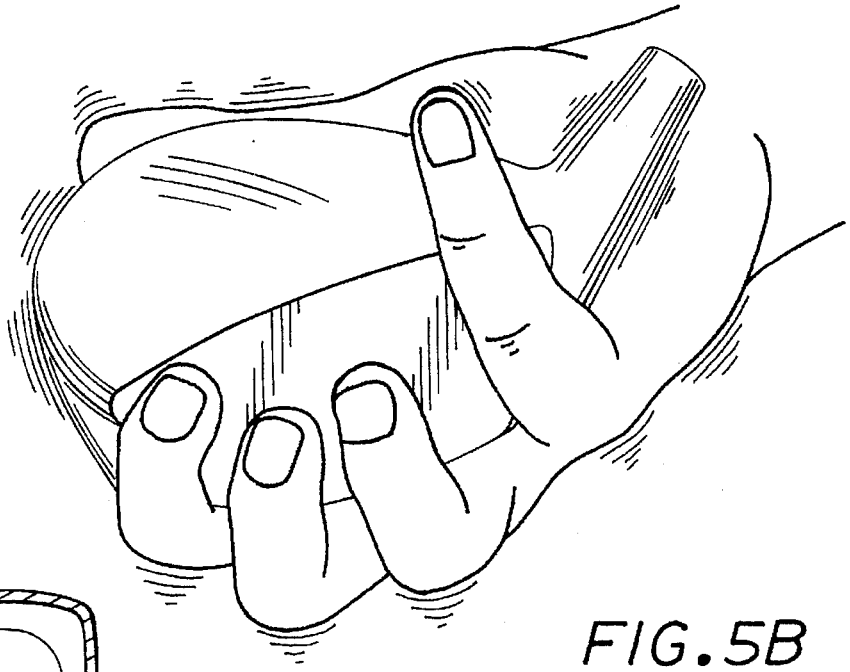
FIG. 4
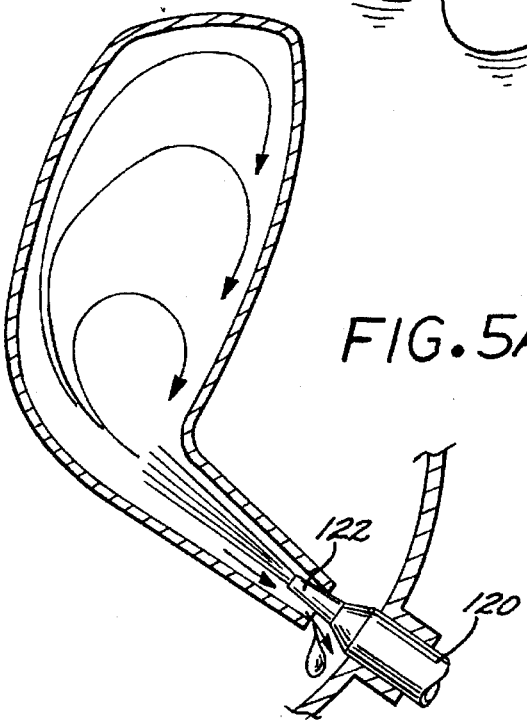
FIG. 5A
FIG. 5B
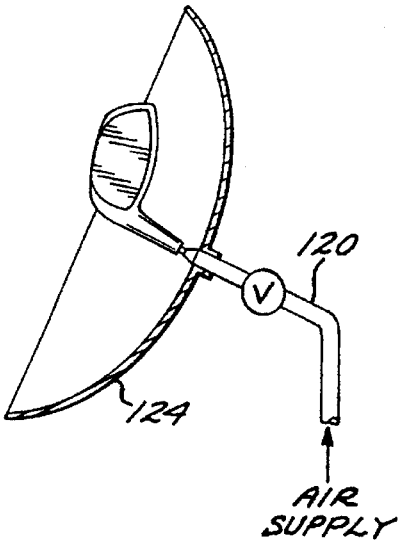

FIG. 6
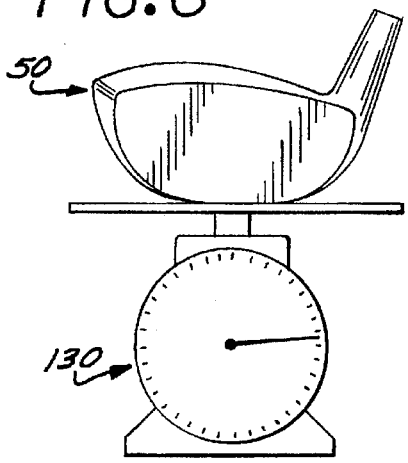
FIG. 7
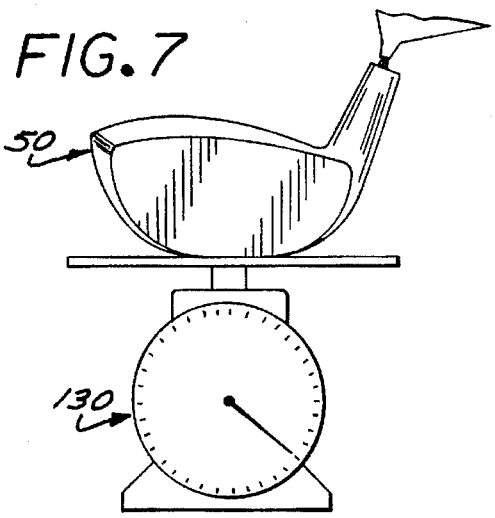
FIG. 8
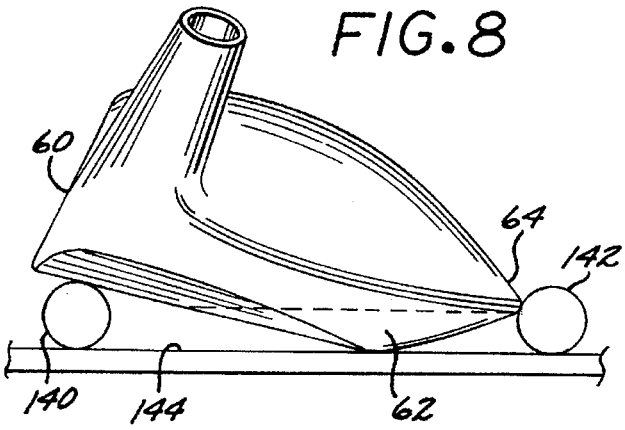
FIG. 9
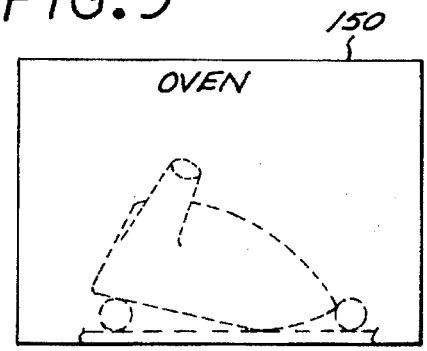
FIG. 10
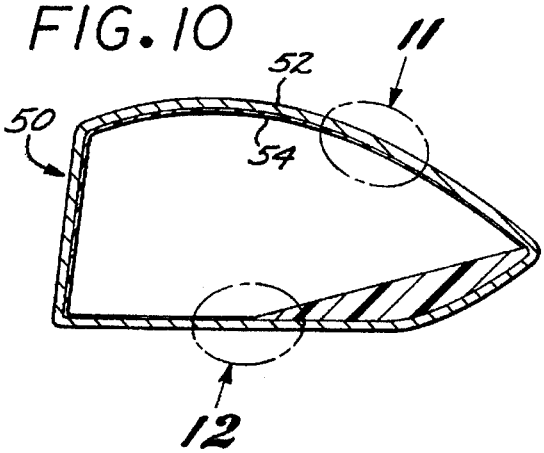
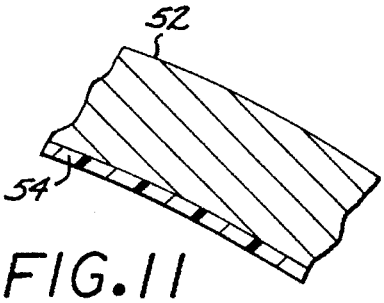
FIG. 11
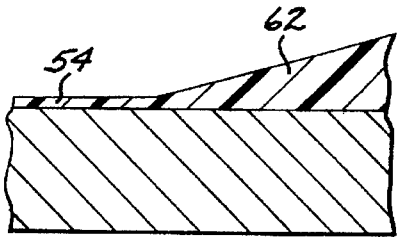
FIG. 12

HOLLOW WOOD-TYPE GOLF CLUB WITH VIBRATION DAMPENING

TECHNICAL FIELD OF THE INVENTION

This invention relates to hollow wood-type golf clubs, and more particularly to an improved wood-type golf club with vibration dampening, and to a method for making such a club.

BACKGROUND OF THE INVENTION

Hollow "wood"-type golf club heads are now in widespread use, and typically are fabricated of a thin hollow shell to which is attached a club shaft. These types of clubs have largely replaced the true wood clubs actually fabricated from persimmon wood, and are used as drivers and fairway "woods." The shell is typically a metal such as stainless steel, aluminum or titanium alloy, but other materials also include graphite, ceramics, polycarbonates and plastics.

A problem associated with hollow wood-type clubs is the vibration generated from impact with the ball. In some cases, the hollow shell may be filled with a foam urethane, which tends to provide some vibration dampening. However, over time and as the result of play with the club, the foam may degrade, and become detached from the interior surface of the head, thereby causing annoying rattles and sounds.

SUMMARY OF THE INVENTION

A vibration-dampened hollow "wood"-type golf club is disclosed, comprising a club shaft and a club head. The club head comprises a hollow shell defining a ball striking surface and head body, the shell having an inner surface defining a hollow cavity. A thin layer of an elastomeric material is adhered to and covers substantially the entire area of the shell inner surface. The thin layer dampens vibrations caused by the impact of the ball striking surface with a golf ball. The thin layer preferably has a thickness in the range of five to ten thousandths of an inch. One exemplary material for the elastomeric material is a polyurethane elastomer.

According to a another aspect of the invention, the club head includes perimeter weighting means comprising an additional mass of the elastomer adhered to the inner surface at an area at which the perimeter weighting is provided.

In accordance with a further aspect of the invention, a method of fabricating a vibration-dampened "wood"-type golf club is disclosed, and comprises the following steps:

providing a hollow "wood"-type shell club head having a hosel with a hosel opening defined therein, the shell club head defining an interior hollow cavity, the hosel opening in communication with the cavity, the shell club head including an interior shell surface defining the cavity;

dispensing a quantity of elastomer material in a liquid, uncured state into the cavity through the hosel opening and causing the liquid material to coat substantially the entire area of the inner shell surface;

allowing the elastomer material to cure to a solid state to define a thin layer of solid elastomer adhered to substantially the entire inner surface of the shell, thereby providing a vibration-dampening function; and attaching a club shaft to the hosel.

BRIEF DESCRIPTION OF THE DRAWING

These and other features and advantages of the present invention will become more apparent from the following detailed description of an exemplary embodiment thereof, as illustrated in the accompanying drawings, in which:

FIGS. 2–9 illustrate steps in an exemplary method for fabricating the golf club head of FIG. 1. FIG. 2 is a simplified schematic diagram of an exemplary system for injecting a vibration dampening material in liquid form into a hollow wood-type golf club head.

FIG. 3 is a cutaway view of a hollow wood-type golf club head illustrating the step of injecting the liquid vibration dampening material into the golf club head using the system of FIG. 2.

FIG. 4 illustrates the step of shaking the golf club head after the liquid material has been injected to ensure that the liquid coats the inner surface of the hollow club head.

FIGS. 5A and 5B illustrate the step of removing excess liquid vibration dampening material using a stream of compressed air.

FIG. 6 shows the optional step of weighing the club head after an excess amount of liquid has been removed. FIG. 7 shows the step of adding a volume of the liquid material sufficient to bring the club head mass up to a desired mass.

FIG. 8 shows the step of positioning the club head on a tilt so as to cause the excess liquid to flow to a desired position within the hollow club head.

FIG. 9 shows the step of oven curing the liquid vibration dampening material at an elevated temperature while the club head is positioned on the tilt.

FIG. 10 is a cross-sectional view of the club head of FIG. 1.

FIGS. 11 and 12 are close-up views of regions of the club head indicated by the phantom circles 11 and 12 of FIG. 10.

DETAILED DESCRIPTION OF THE PREFERRED EMBODIMENT

Figure 1:
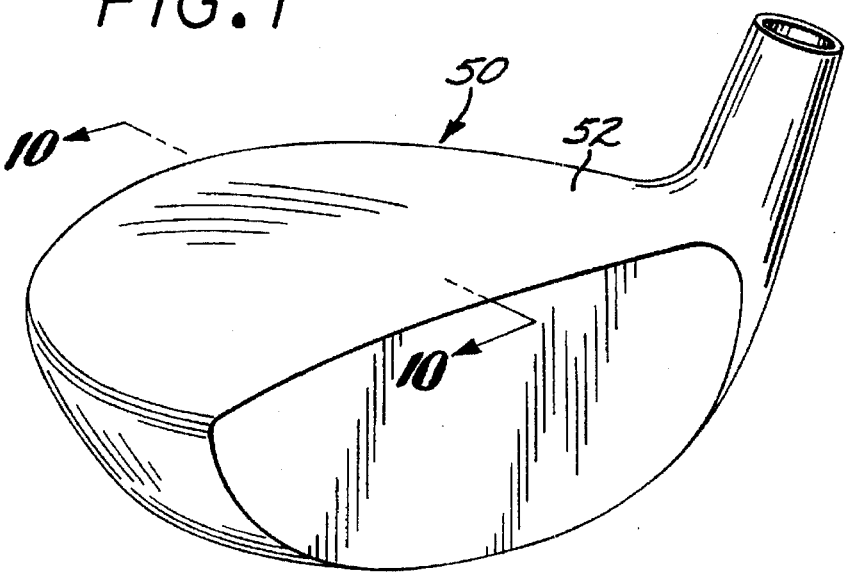
FIG. 1 is an isometric view of a wood-type golf club head embodying this invention.

FIG. 1 is an isometric view of a hollow wood-type golf club head 50 constructed with the vibration dampening system according to this invention. The club head 50 is fabricated of a thin hollow shell, which typically is a metal, but can alternately be a ceramic or other material. The shell includes an inner surface 70 (FIG. 3) which defines the shell cavity 56. As shown in FIGS. 10–12, the entire area of the interior surface of the shell 52 is coated in accordance with the invention with a thin layer 54 of a polyurethane elastomer. This layer completely coats the inner shell surface, and provides substantial vibration dampening. The layer changes the sound of the head impacting the ball, lowering the impact frequency. As a result, the feel of the club is improved, and the vibrational energy transferred to the club player is reduced.

One exemplary preferred material for the layer 52 is the F-70 A/B 70 Shore A polyurethane elastomer available from BJB Enterprises, Inc., 13912 Nautilus Drive, Garden Grove, Calif. 92643. This material is mixed from liquid parts A and B, with part A the polyurethane resin and part B the polyurethane curing agent. This exemplary material and its characteristics are further described in a product data sheet entitled "F-70A/B 70 Shore A polyurethane Elastomer Ratio: 100/100."

Figure 2:
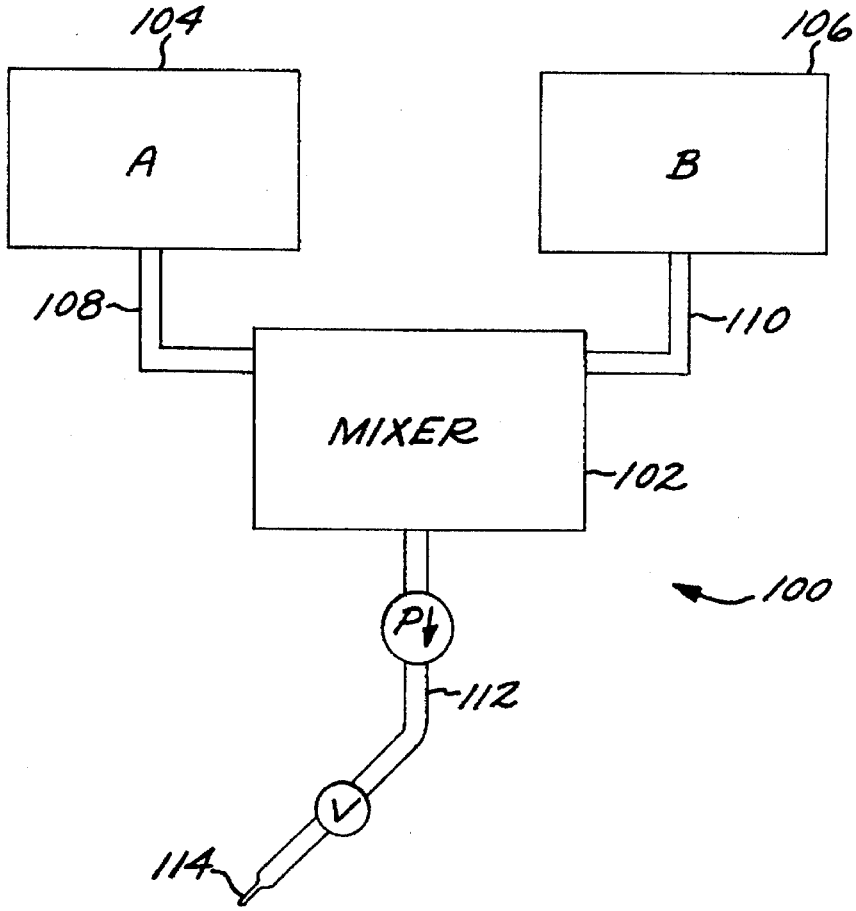

FIGS. 2–9 illustrate steps in an exemplary method for fabricating the golf club head 50 of FIG. 1. FIG. 2 is a simplified schematic diagram of an exemplary system 100 for injecting the vibration dampening material in liquid form into the hollow wood-type golf club head 50. The polyurethane elastomer is formed from two liquid parts A and B, which are mixed together when the elastomer is to be applied and allowed to cure. Thus, the parts A and B are each held in respective containers 104 and 106 in liquid form. The system includes a mixer 102 to which the containers are connected by tubes 108 and 110 to supply the parts A and B. In this exemplary embodiment, the mixer is a mechanical apparatus for mechanically mixing the two liquid parts, although the constituent parts could also be mixed statically. The mixer includes an impeller (not shown) which supplies the mixed product from the mixer to an outlet tube 112.

FIG. 3 is a cutaway view of the wood-type golf club head 50 illustrating the step of injecting the liquid vibration dampening material into the golf club head using the system 100 of FIG. 2. The tip 114 of the outlet tube 112 is inserted into the hosel opening 58 of the club head, which will ultimately receive the end of the club shaft. The mixed product of the parts A and B is in a thin liquid form and is emitted from the tip 114 under pressure. A quantity of the liquid is released into the hollow cavity 56 of the club head, typically on the order of 12 grams for one exemplary club head.

In the next step of the process, illustrated in FIG. 4, the club head 50 with the quantity of liquid material deposited therein is agitated, e.g., by hand, to coat the entire interior surface 70 of the club shell with this liquid.

In the next step, illustrated in FIG. 5A, compressed air is released into the interior of the shell through the hosel opening, creating turbulence within the cavity 56 and ejecting excess liquid material. This is accomplished in an exemplary embodiment by the arrangement shown in FIG. 5B, wherein pressurized air, e.g., at about 25 psi, is released through tube 120 and nozzle 122 into the cavity 56 with the club head held at an inverted attitude. A shroud 124 collects the excess liquid which drips from the hosel opening.

FIG. 6 shows the next (optional) step of weighing the club head 50 with a weight scale 130 after an excess amount of liquid has been removed as shown in FIG. 5B. There are PGA regulations which govern the permissible range of club head weights, and so each type of club head is typically constructed by the manufacturer to have a predetermined weight or mass. The shell 52 of the head can be designed and constructed to have a nominal weight which is a large percentage of the ultimate desired club weight, leaving a small portion of the weight to be supplied by the vibration dampening material. The purpose of the weighing step as shown in FIG. 6 is to determine the weight of the head 50 after the liquid elastomer has been applied and before this material has been cured. Typically, the head is designed to leave the head somewhat lighter than the nominal finished weight after the liquid elastomer has been applied. The weighing process determines how much additional weight can be added to the club head 50 to bring its weight up to the nominal finished weight. This additional weight is the supplied by pouring another volume of the liquid elastomer into the hollow cavity 56 through the hosel opening 58, preferably while the head is on the weight scale 130, as shown in FIG. 7. This permits the desired finished weight to be accomplished precisely at this stage of the processing.

FIG. 8 shows the step of positioning the club head on a tilt so as to cause the excess liquid added as shown in FIG. 7 to flow to a desired position within the hollow club head. This is to achieve a desired weighting of the club head. For example, the manufacturer may typically desire to add the additional weight toward the rear of the head, away from the striking face 60. This can be achieved by securing rods or dowel 140 under the head face 60, lifting this part of the club head in relation to the rear area 64 of the head. Another rod or dowel 142 can be positioned at the rear of the club head to prevent the head from sliding or rolling off the dowel 140. Both dowels 140 and 142 are supported on a flat surface 144 in this exemplary fixture. As a result of the tilted position of the club head, the excess liquid elastomer material flows to the rear area 64 and pools there, forming a thickened region 62 of the elastomer. This will achieve a rear weighting of the club head, due to the mass of the thickened region 62. 0f course, other weighting configurations may alternatively be employed by tilting the head so that the toe or heel of the club is the lowest point, so that the extra liquid elastomer pools at the toe or heel.

Next, FIG. 9 shows the step of oven curing the liquid vibration dampening material at an elevated temperature while the club head 50 is positioned on the tilt. Thus, the flat surface 144 may be a sheet of plywood or metal which can readily be moved into a curing oven 150, so that the head 50 can be heated for some desired period of time to cure the polyurethane elastomer material to a solidified state. For the exemplary material described above, the head can be baked for a period of two hours at a temperature in the range of 160 degrees Fahrenheit to 200 degrees Fahrenheit. Once the material has cured, the head 50 can be removed from the oven, allowed to cool, and the shaft fitted to the hosel opening 58 in the conventional manner to complete the fabrication process.

Preferably, the thickness of the layer of elastomer is in the range of 5 to 10 mils about the interior surface of the cavity, although the thickness in the optional thickened region 62 will of course depend upon the amount of mass added to bring the head up to the finished weight.

The finished golf club is found to have improved vibration dampening, so that the vibration frequency of energy imparted upon ball impact is reduced. The affects the impact sound, and improves the comfort and feel of play with the metal wood over conventional metal woods.

It is understood that the above-described embodiments are merely illustrative of the possible specific embodiments which may represent principles of the present invention. Other arrangements may readily be devised in accordance with these principles by those skilled in the art without departing from the scope and spirit of the invention.

What is claimed is:

1. A vibration-dampened hollow"wood"-type golf club, comprising:

a club shaft; and a "wood"-type club head, comprising a hollow shell defining a ball striking surface and head body, the shell having an inner surface defining a hollow cavity, and a unitary thin layer of an elastomeric material adhered to and covering substantially the entire area of the shell inner surface, the unitary thin layer for dampening vibrations caused by the impact of the ball striking surface with a golf ball, and wherein said thin layer of elastomeric material is attached to said inner surface of said shell without any intermediate coating or adhesive between said thin layer and said inner surface.

2. The golf club of claim 1 wherein the thin layer has a thickness in the range of five to ten thousandths of an inch.

3. The golf club of claim 2 wherein the elastomeric material is a polyurethane elastomer.

4. The golf club of claim 2 wherein the elastomeric material has a Shore hardness rating in the range of 70–72.

5. The golf club of claim 1 further comprising perimeter weighting means, said means comprising a mass of said elastomer adhered to said inner surface at an area at which said perimeter weighting is provided.

6. The golf club of claim 1 wherein said shell is fabricated of a metal.

7. A method of fabricating a vibration-dampened "wood"-type golf club, comprising:

providing a hollow "wood"-type shell club head having a hosel with a hosel opening defined therein, the shell club head defining a wall defining a ball striking face and an interior hollow cavity, the hosel opening in communication with the cavity, the shell club head including an interior shell surface defining the cavity, the interior shell surface including an interior surface on said wall defining the ball striking face;

dispensing a quantity of elastomer material in a liquid, uncured state into the cavity and causing the liquid material to coat substantially the entire area of the inner shell surface;

allowing the elastomer material to cure to a solid state to define a thin layer of solid elastomer adhered to substantially the entire inner surface of the shell including said interior surface on said wall, thereby providing a vibration-dampening function; and attaching a club shaft to the hosel.

8. The method of claim 7 wherein said step of allowing the elastomer to cure includes baking the club head in an oven at an elevated temperature for a period of time.

9. The method of claim 7 wherein said elastomer is a polyurethane elastomer.

10. The method of claim 7 wherein said elastomer has a Shore hardness rating in the range of 70–72.

11. The method of claim 7 wherein said elastomer layer has a thickness in the range of five to ten thousandths of an inch.

12. The method of claim 7 wherein said thin layer is a unitary layer.

13. A method of fabricating a vibration-dampened "wood"-type golf club, comprising:

providing a hollow "wood"-type shell club head having a hosel with a hosel opening defined therein, the shell club head defining an interior hollow cavity, the hosel opening in communication with the cavity, the shell club head including an interior shell surface defining the cavity;

dispensing a quantity of elastomer material in a liquid, uncured state into the cavity through the hosel opening and causing the liquid material to coat substantially the entire area of the inner shell surface;

removing excess liquid elastomer from the cavity;

allowing the elastomer material to cure to a solid state to define a thin layer of solid elastomer adhered to substantially the entire inner surface of the shell, thereby providing a vibration-dampening function; and attaching a club shaft to the hosel.

14. The method of claim 13 wherein said step of removing excess elastomer includes directing a stream of gas under pressure into the cavity through the hosel opening while inverting the club head, so that excess liquid elastomer is expelled from the cavity through the hosel opening.

15. A method of fabricating a vibration-dampened "wood"-type golf club, comprising:

providing a hollow "wood"-type shell club head having a hosel with a hosel opening defined therein, the shell club head defining an interior hollow cavity, the hosel opening in communication with the cavity, the shell club head including an interior shell surface defining the cavity;

dispensing a quantity of elastomer material in a liquid, uncured state into the cavity through the hosel opening and causing the liquid material to coat substantially the entire area of the inner shell surface;

weighing the club head after dispensing the liquid elastomer into the cavity;

dispensing an additional quantity of said liquid elastomer into the cavity through the hosel opening to bring the club head weight up to a predetermined nominal club weight;

allowing the elastomer material to cure to a solid state to define a thin layer of solid elastomer adhered to substantially the entire inner surface of the shell, thereby providing a vibration-dampening function; and attaching a club shaft to the hosel.

16. The method of claim 15 further including maintaining the club head at an attitude which causes the additional quantity of liquid elastomer to pool at a predetermined area of the cavity during the curing step.

17. The method of claim 16 wherein said cavity area is the rear region of the cavity, said additional quantity of elastomer providing perimeter weighting at said rear region of the cavity.

18. A vibration-dampened hollow "wood"-type golf club, comprising:

a club shaft; and a "wood"-type club head, comprising a hollow shell defining a head body, the shell having an inner surface defining a hollow cavity, and a thin layer of an elastomeric material adhered to and covering substantially the entire area of the shell inner surface including the inner surface of a shell wall defining a ball striking surface, the thin layer of elastomeric material attached to said inner surface of said shell without any intermediate coating or adhesive between said thin layer and said inner surface, the thin layer having a thickness in the range of five to ten thousandths of an inch, the thin layer for dampening vibrations caused by the impact of the ball striking surface with a golf ball.

19. A vibration-dampened hollow "wood"-type golf club, comprising:

a club shaft; and a "wood"-type club head, comprising a hollow shell defining a ball striking surface and head body, the shell having an inner surface defining a hollow cavity, and a unitary thin layer of an elastic material adhered to and covering substantially the entire area of the shell inner surface, the thin layer of elastic material attached to said inner surface of said shell without any intermediate coating or adhesive between said thin layer and said inner surface, the unitary thin layer for dampening vibrations caused by the impact of the ball striking surface with a golf ball.

20. A method of fabricating a vibration-dampened "wood"-type golf club, comprising:

providing a hollow "wood"-type shell club head having a hosel with a hosel opening defined therein, the shell club head defining a wall defining a ball striking face and an interior hollow cavity, the hosel opening in communication with the cavity, the shell club head including an interior shell surface defining the cavity, the interior shell surface including an interior surface on said wall defining the ball striking face;

dispensing a quantity of elastic material in a liquid, uncured state into the cavity and causing the liquid material to coat substantially the entire area of the inner shell surface;

allowing the elastic material to harden to a solid state to define a thin layer of solid elastic material adhered to substantially the entire inner surface of the shell including said interior surface on said wall, thereby providing a vibration-dampening function; and attaching a club shaft to the hosel.

* * * * *